United States Patent [19]

Bergström

[11] 4,288,056

[45] * Sep. 8, 1981

[54] DEVICE FOR SETTING THE DIRECTION AND/OR THE INCLINATION OF AN ELONGATED ROCK DRILLING APPARATUS

[75] Inventor: Claes-Gustav Bergström, Saltsjöbaden, Sweden

[73] Assignee: Atlas Copco Aktiebolag, Nacka, Sweden

[ * ] Notice: The portion of the term of this patent subsequent to Jun. 23, 1998, has been disclaimed.

[21] Appl. No.: 88,625

[22] Filed: Oct. 26, 1979

Related U.S. Application Data

[63] Continuation-in-part of Ser. No. 897,515, Apr. 18, 1978.

[30] Foreign Application Priority Data

Oct. 27, 1978 [SE] Sweden ..... 7811159

[51] Int. Cl.[3] ..... E21C 1/00; E21C 35/06

[52] U.S. Cl. ..... 248/542; 33/365; 33/395; 33/397; 173/20; 173/43; 248/647

[58] Field of Search ..... 33/1 N, 185 R, 185 V, 33/395, 397, 399, 365, 366; 89/41 B, 41 CE; 91/419; 172/4.5; 173/1, 2, 20, 21, 43; 182/2; 248/550, 542, 647; 318/489

[56] References Cited

U.S. PATENT DOCUMENTS

| | | | |
|---|---|---|---|
| 3,094,796 | 6/1963 | Atchley | 172/4.5 |
| 3,113,283 | 12/1963 | Fliegler et al. | 338/46 |
| 3,896,885 | 7/1975 | Dahlstrom | 173/43 X |
| 3,900,073 | 8/1975 | Crum | 33/185 V X |
| 3,945,129 | 3/1976 | Bergkvist | 33/399 |
| 3,975,831 | 8/1976 | Jysky et al. | 33/366 X |
| 4,022,284 | 5/1977 | Crow | 173/2 |
| 4,159,577 | 7/1979 | Bergkvist | 33/366 |

FOREIGN PATENT DOCUMENTS

| | | |
|---|---|---|
| 7314833 | 10/1973 | Sweden . |
| 362113 | 11/1973 | Sweden . |
| 7301784 | 12/1975 | Sweden . |
| 7310672 | 3/1977 | Sweden . |
| 7611511 | 4/1978 | Sweden . |
| 1325240 | 8/1973 | United Kingdom . |

*Primary Examiner*—Wm. Carter Reynolds

*Attorney, Agent, or Firm*—Frishauf, Holtz, Goodman and Woodward

[57] ABSTRACT

A device for setting the direction and/or inclination of an elongated rock drilling apparatus. The actual value of the direction in each of two perpendicular planes is sensed by a rotatable screen having a pattern of parallel opaque lines separated by interspaces. Corresponding set values are set by prepositioning a carrying member on which a second screen is mounted which also has a pattern of lines and interspaces. The elongated rock drilling apparatus and the carrying member are moved in common until the line patterns on the screens form a desired moire pattern.

6 Claims, 10 Drawing Figures

DEVICE FOR SETTING THE DIRECTION AND/OR THE INCLINATION OF AN ELONGATED ROCK DRILLING APPARATUS

CROSS REFERENCE TO RELATED APPLICATION

This is a continuation-in-part of U.S. Patent Application Ser. No. 897,515, filed Apr. 18, 1978.

BACKGROUND OF THE INVENTION

The present invention relates to a device for setting the direction and/or the inclination of an elongated rock drilling apparatus. The elongated rock drilling apparatus is swingable by means of at least one positioning power means. The inclination of the elongated rock drilling apparatus is sensed and indicated by means of angle sensing means which is carried adjustably relative to the elongated rock drilling apparatus.

The present invention relates to manual devices for positioning an elongated rock drilling apparatus. Such devices are previously known which comprise a pendulum or level system attached to the rock drilling apparatus. In a pendulum system the deviation or deflection of a pendulum is read on a graduated scale and in a level system the position of a gas bubble is watched in a reading window.

One object of the present invention is to provide a device by means of which the rock drilling apparatus can be rapidly and accurately positioned for drilling of holes having a desired inclination in a desired direction.

SUMMARY OF THE INVENTION

According to the present invention, a rock drilling apparatus comprises a carrier; a feed beam pivotally mounted to the carrier so as to be pivotable in a first plane about a first axis and to be pivotable in a second plane about a second axis that is at right angles to the first axis; a rock drill movable along the feed beam and arranged to drill a hole that is parallel with the feed beam; first power means to effect swinging of the feed beam about the first axis; second power means to effect swinging of the feed beam about the second axis; a first member affixed to the feed beam; a second member universally pivotably but non-rotatably carried by the first member; indicating means affixed to the second member for indicating when an axis of the second member is vertical; means for adjustment of the position of the second member relative to the first member in order to adjust the angle between the axis of the second member and an axis that is parallel with the feed beam; and means to swing the second member about the axis that is parallel with the feed beam such that the axis of the second member follows a conical path about the axis that is parallel with the feed beam. The indicating means comprises a first indicating device arranged to indicate movements of the feed beam in the first plane irrespective of the actual relative position between the first and second members; and a second indicating device arranged to indicate movements of the feed beam in the second plane irrespective of the actual relative position between the first and second members.

Each of the first and second indicating devices comprises a pair of screens, one screen being fixed with respect to the second member and the other screen being pivotable and biased to take up a predetermined position relative to the vertical, the pair of screens forming an interference pattern that visually indicates the position of the second member relative to the vertical. The screens preferably have parallel opaque lines separated by interspaces. The correct or desired position of the rock drill is indicated by a desired moire pattern on the screens.

The invention is described in detail in the following description with reference to the accompanying drawings in which one embodiment is shown by way of example. It is to be understood that this embodiment is only illustrative of the invention and that various modifications thereof may be made within the scope of the claims following hereinafter.

DETAILED DESCRIPTION

Figure 1:
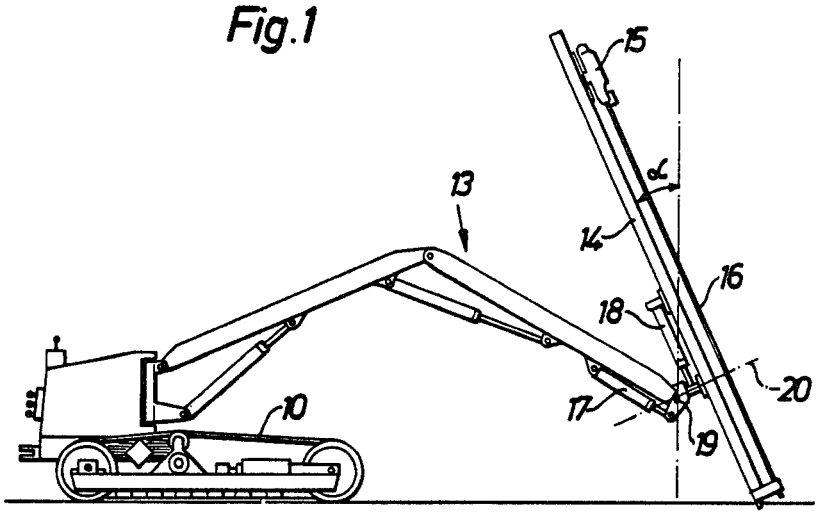
FIG. 1 illustrates diagrammatically a side view of a mobile drill rig provided with a device according to the invention.
Figure 2:
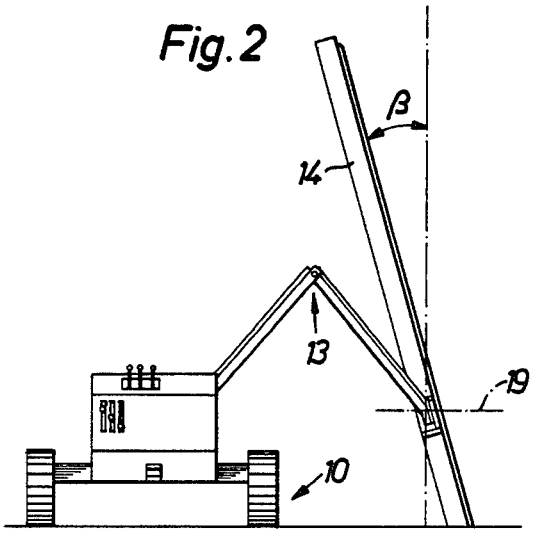
FIG. 2 is a diagrammatic view of the drill rig of FIG. 1 as seen from the rear.

The drill rig 10 shown in FIGS. 1 and 2 is of conventional construction. The drill rig swingably supports a drill boom 13, which carries an elongated rock drilling apparatus comprising a feed bar 14 and a rock drilling machine 15. The rock drilling machine 15 is slidably guided on the feed bar 14 and rotates a drill rod 16 and delivers impacts thereagainst. The feed bar 14 can be swung about an axis 19 by means of a hydraulic cylinder 17 for adjusting the tilting angle $\alpha$ of the feed bar relative to the vertical line. The feed bar 14 can also be swung about an axis 20 which is perpendicular to the axis 19 by means of a hydraulic cylinder 18 for adjusting the turning angle $\beta$ (FIG. 2) of the feed bar 14 relative to the vertical line.

The device for setting the inclination and/or direction of the feed bar 14 comprises two angle sensing means or angle indicators 21,22 (FIGS. 3 and 5) which are mounted perpendicular to each other.

The angle indicators 21,22 are mounted on a carrying member 12. The carrying member 12 is attached to a shaft 23 which is perpendicular to the carrying member 12. The shaft 23 is connected to another shaft 25 through a universal joint 24. The shaft 25 is fixed relative to the feed bar 14, preferably parallel thereto. A casing 26 of bellows-type is turnable around the shafts 23,25 over roller bearings 27, 28. The angle between the shafts 23, 25 at the universal joint 24 can be adjusted by means of an adjusting screw 29 which is provided with portions 30,31 having opposite thread directions. The casing 26 is provided with a pointer 32. The pointer 32 cooperates with a graduated scale 33 which is fixed relative to the shaft 23, thereby indicating the turning angle about the universal joint 24.

A plate 34 is turnable around the shaft 23 and can be locked relative thereto by means of a lock screw 35. The plate 34 carries a collimator sight 36. The plate 34 can be fixed to the casing 26 by means of a plate spring 38 and a pin 37 thereon which can snap into a hole 39 in the bottom of the casing 26. Pin 37 and hole 39 form a snaplock.

Figure 3:
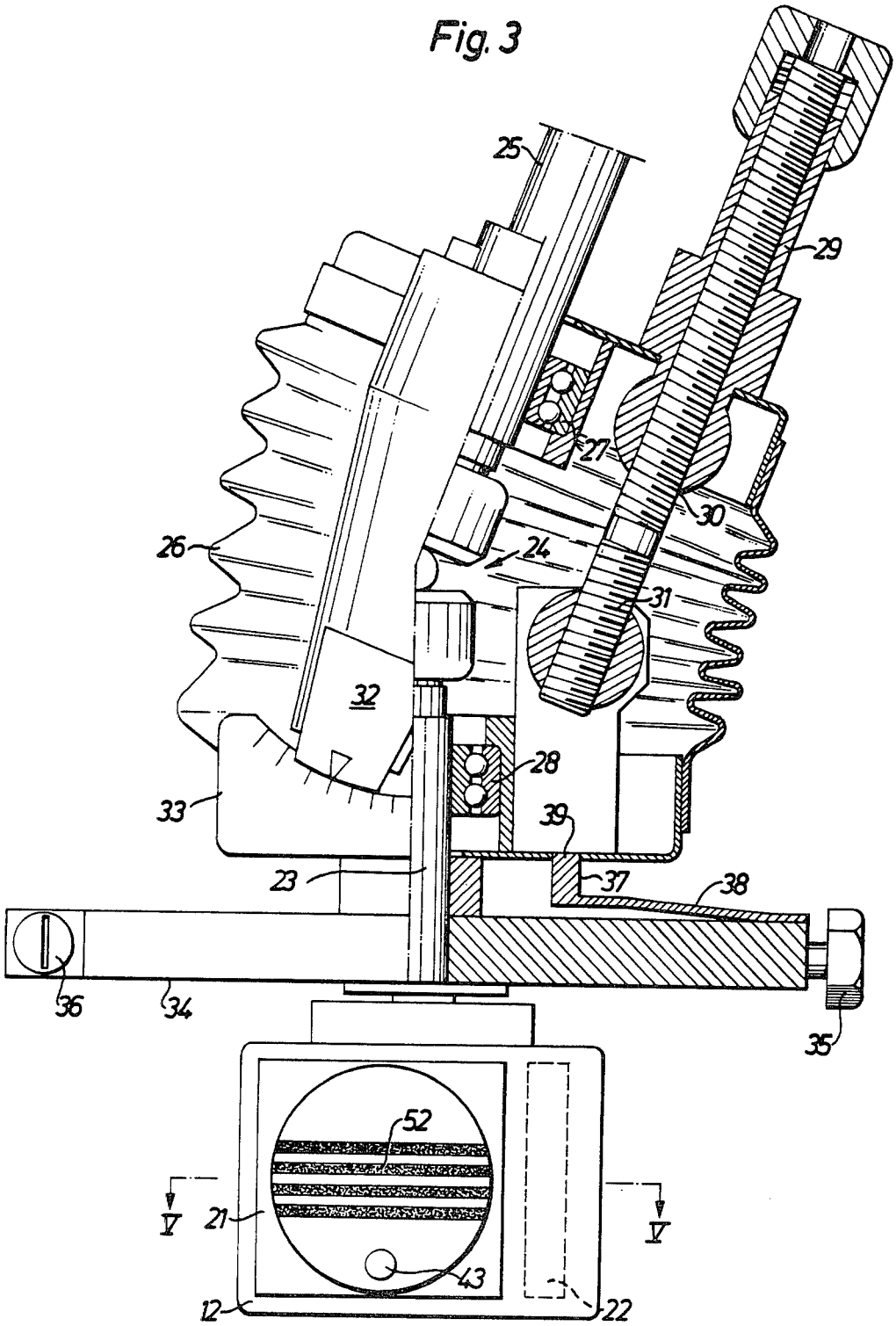
FIG. 3 shows, partly in section, one embodiment of a device according to the invention.

The set valve of the inclination of the feed bar 14 in a vertical plane passing through the feed bar 14 and the set value of the direction of this vertical plane can be preset by means of the device in FIG. 3. The desired value of the inclination is set on the graduated scale 33 by means of the adjusting screw 29. In order to preset the direction of the mentioned vertical plane, the operator first sees to it that the snaplock 37, 39 is in register so that the plate 74 is fixed to the housing 26, and that the lock screw 35 is undone so that the plate 34 is free to rotate on the shaft 23. Then, the operator turns the plate 34 into its horizontal position. This can always be done since the shaft 23 will swing in a conical path. The plate 34 need not be perfectly horizontal but it should be nearly horizontal. The operator now disconnects the snap lock 37, 39, whereupon the desired direction of the vertical plane through the feed bar 14 is set by aiming in the desired drilling direction toward a specific distant reference object in the surrounding territory by means of the collimator sight 36. The plate 34 is then locked to the shaft 23 by means of lock screw 35, whereupon the casing 26 is turned until the pin 37 snaps into the hole 39.

Thus, the prepositioning is completed and the plate 34 and thus also the carrying member 12 fixed thereto are now in an initial position which deviates from a horizontal position. The requirement which now must be met in order to obtain the desired inclination and direction at the feed bar 14 is that the feed bar 14 is moved about the axis 19, 20 until the carrying member 12 and thus also the plate 34 are brought back to a horizontal position, i.e. a position in which the shaft 23 is vertical. FIG. 3 shows the carrying member 12 in its final position after completed adjustment of the feed bar 14. This time, the plate 34 should be accurately leveled.

When a plurality of parallel holes are to be drilled for example in bench drilling, the correct hole direction for each hole is set simply by aiming towards the same distant reference object and levelling the carrying member 12.

There can also be provided another collimator sight at a right angle to the collimator sign 36 so that it will be possible to aim along a bench at a right angle to the desired drilling direction. It would also be possible to have a collimator sign that can be adjustable relative to the plate 34 which would be advantageous when there is no distant object to aim against in the two directions mentioned. Then, the operator could choose a distant object in any direction at an angle to the desired direction for drilling.

Figure 4:
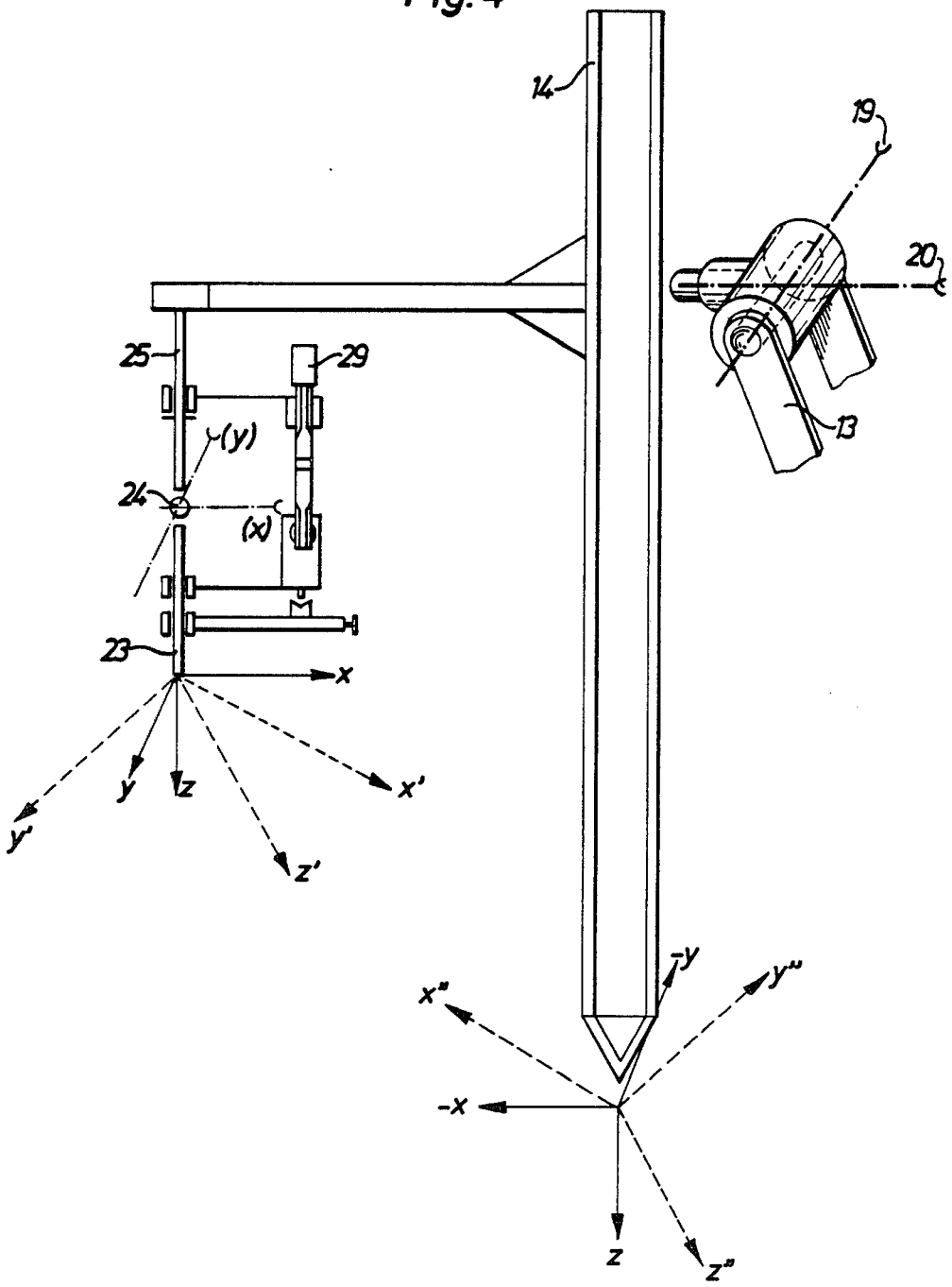
FIG. 4 illustrates the relationship between the prepositioning of the carrying member of the angle sensing means and the subsequent positioning of the rock drilling apparatus.

FIG. 4 illustrates the co-ordinate transformation which occurs during positioning of the feed bar 14. In its horizontal position shown in FIG. 3 the carrying member 12 is coplanar with a horizontal plane xy, and the shaft 23 coincides with the z axis of the system of co-ordinates. If the shaft 25 is aligned with the shaft 23, as shown in FIG. 4, the feed bar 14, then, extends in the direction of the z axis. Suppose now that the carrying member 12 is inclined and turned and that the xyz system follows the movement of the carrying member 12 such that the xyz system is transformed to a $x^1$, $y^1$, $z^1$ system. In order to bring the carrying member 12 back to its horizontal position the feed bar 14 must be swung in such a way that the xyz-system, if it is associated with and following the feed bar, is transformed to a $x^{11}y^{11}z^{11}$ system. It can be shown that the requirement which must be met in order to obtain accurate positioning of the feed bar 14 with respect to inclination and direction is that $-x^1$; $-y^1$; $z^1$ coincide with $x^{11}$; $y^{11}$; $z^{11}$.

Figure 6:
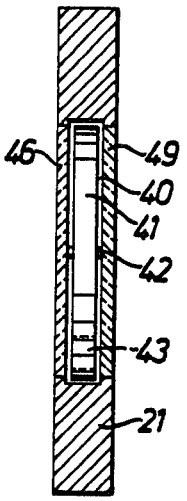
FIG. 6 shows diagrammatically a section through an angle sensing means.

As can be seen in FIG. 6, the angle indicator 21 has an inner cavity 40 in which a movable part 41 is mounted rotatably around an axis 42. In the part 41 there is inserted a member 43 between the rotational axis 42 and the periphery of the movable part 41. The member 43 has higher density than the rest of the movable part 41 which means that the center of mass of the part 41 does not coincide with the rotational axis 42. Therefore, the movable part 41 will always be rotated by gravity in such a way that a line passing through the rotational axis 42 and the center of mass of the part 41 coincides with the vertical line.

Figure 7:
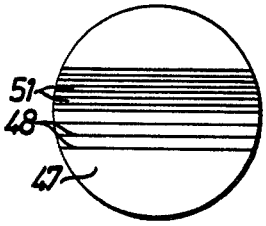
FIGS. 7 and 8 show two screen discs forming part of an angle of an angle sensing means.
Figure 8:
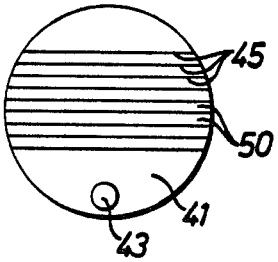

The movable part 41 has the shape of a circular screen disc, see FIG. 8, which has a screen comprising opaque parallel lines 45, for the sake of clearness shown as thin lines, and transparent interspaces 50. The wall 46 of the angle indicator 21 which faces an observer thereof comprises a screen disc 47, see FIG. 7, which has a screen comprising opaque parallel lines 48 and transparent interspaces 51. The wall 49 turned away from an observer of the indicator is preferably transparent. The screens may be designed in suitable manner, for example as shown in U.S. Pat. No. 3,945,129 and Swedish Patent Nos. 7307577-2 and 7611511-2.

Figure 9:
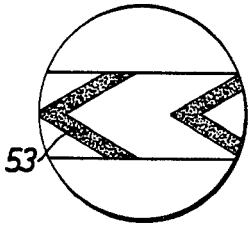
FIGS. 9 and 10 show two different moire patterns.
Figure 10:
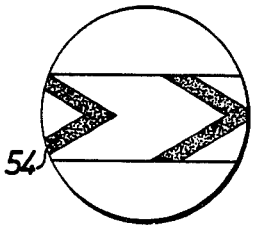

By means of the screen design shown in FIGS. 7 and 8 a moire pattern is produced comprising wide dark mutually parallel bands 52, see FIG. 3, when the opaque lines of the two screen discs 41,47 are in parallel interrelationship. When the movable part 41 is turned a small angle in a clockwise direction relative to the carrying member 12, the moire pattern shown in FIG. 9 is produced due to the fact that the opaque lines 45 on the screw disc 41 will form said angle with the opaque lines on the screen disc 47. In the moire pattern in FIG. 9 the wide dark bands 53 are inclined relative to the lines on the screen disc 47. The bands on both sides of a diameter of of the disc 47 separating two areas having different wide interspaces are reflected images of each other such that the bands have the shape of arrows. When the movable part 41 is turned a small angle in a counter clockwise direction relative to the carrying member 12 the moire pattern shown in FIG. 10 is produced in a corresponding manner. The moire pattern in FIG. 10 has wide arrow-shaped dark bands 54. The arrows formed by the bands 54 (FIG. 10) and by the bands 53 (FIG. 9) point in opposite directions.

The above moire patterns are very sensitive to small angular changes and are extremely readily readable which means that the feed bar 14 can be very accurately positioned by means of the angle indicators 21,22.

Figure 5:
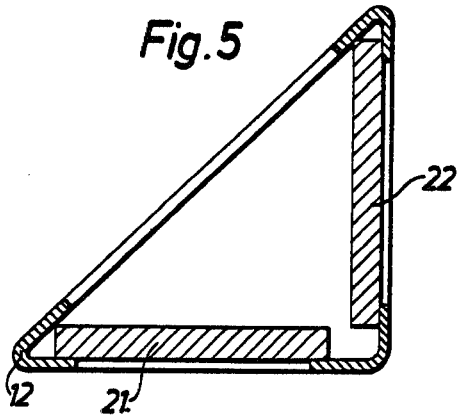
FIG. 5 is a horizontal section taken along the line V—V in FIG. 3.

According to the invention two angle indicators 21,22 are used, each comprising a pair of screens 41,47 which are located in mutually perpendicular planes, see FIG. 5. Due to this arrangement, the pairs of screens 41,47 indicate the inclination of the feed bar 14 in each of the two planes. In order to faciliate the positioning of the feed bar 14, the angle indicators 21,22 are preferably oriented relative to the feed bar in such a way that one of the angle indicators shows the position of the feed bar in the tilting plane, i.e., the tilting angle $\alpha$, and the other the position of the feed bar in the turning plane, i.e., the turning angle $\beta$. This is illustrated in FIG. 4 which shows that the axis 20—the axis of turning—is parallel with the x axis and that the axis 19—the axis of tilting—is parallel with the y axis. The angle indicator 21 senses swinging movement about the y axis only, that is, the pivoting about the axis 19 that is carried out by means of the hydraulic cylinder 17. The angle indicator 22 senses swinging movement about the x axis only, that is, the pivoting about the axis 20 that is carried out by means of the hydraulic cylinder 18.

The angle indicators 21, 22 of the kind described are very stable when subject to movement in a plane perpendicular to their sensing plane. This is important since it makes it possible for the operator to first adjust one of the hydraulic cylinders 18, 19 in order to get the respective one of the indicators 21, 22 into correct read-out and then immediately adjust the other hydraulic cylinder in order to get the other indicator into correct read-out. If the later adjustment is not too big (that is, if it is smaller than 15°-20° in a preferred embodiment) then no further adjustment need be made. Normally, the operator moves the feed beam in the two planes simultaneously without looking at the indicators until the feed beam is reasonably close to the correct direction, before making the two final adjustments, one at the time. Thus, the set up time for a hole is very short and the adjustment is very easy to carry out without requiring great skill on the part of the operator.

It is obvious that a pattern according to FIG. 9 or FIG. 10 teaches in which direction the carrying member 12 must be turned relative to the vertical line in order to reach a position where both of the angle indicators 21,22 are vertical, and thus a pattern according to FIG. 3 is produced. This fact highly simplifies the positioning of the feed bar.

I claim:

1. A rock drilling apparatus comprising:

a carrier (10, 13);

a feed beam (14) pivotally mounted to said carrier so as to be pivotable in a first plane about a first axis (19) and to be pivotable in a second plane about a second axis (20) that is at right angles to said first axis (19);

a rock drill (15) movable along said feed beam and arranged to drill a hole that is parallel with said feed beam;

first power means (17) coupled to said feed beam (14) to effect swinging of said feed beam about said first axis;

second power means (18) coupled to said feed beam (14) to effect swinging of said feed beam about said second axis;

a first member (25) affixed to said feed beam (14);

a second member (23,12) universally pivotably but non-rotatably carried by said first member (25);

indicating means (21, 22) affixed to said second member (23, 12) for indicating when an axis of said second member (23) is vertical;

means (29) for adjustment of said second member (23) relative to said first member (25) in order to adjust the angle between said axis of said second member (23) and an axis that is parallel with said feed beam (14); and means (26,34) coupled to said second member (23) for swinging said second member about said axis that is parallel with said feed beam such that said axis of said second member (23) follows a conical path about said axis that is parallel with said feed beam;

said indicating means (21,22) comprising:

a first indicating device (21) arranged to indicate movements of said feed beam (14) in said first plane irrespective of the actual relative position between said first and second members (25 and 23, respectively); and a second indicating device (22) arranged to indicate movements of said feed beam (14) in said second plane irrespective of the actual relative position between said first and second members;

each of said first and second devices (21,22) comprising a pair of screens (41,47), one of said screens (47) being fixed with respect to said second member (23,12), and the other of said screens (41) being pivotable and biased to take up a predetermined position relative to the vertical, said pair of screens (41,47) forming an interference pattern that visually indicates the position of said second member (23,12) relative to the vertical.

2. The rock drilling apparatus of claim 1 wherein said means (26,34) for swinging said second member (23,12) comprises a sighting means (36).

3. The rock drilling apparatus of claim 2 wherein said sighting means (36) and said means (26,34) for swinging said second member (23,12) are selectively adjustable in position relative to said second member.

4. The rock drilling apparatus of claim 1 wherein said first member (25) comprises a first shaft and said second member (23,12) comprises a second shaft (23) universally pivotally connected to said first shaft but nonrotatable relative to said first shaft.

5. The rock drilling apparatus of claim 4 wherein said first shaft (25) is connected to said feed beam (14).

6. The rock drilling apparatus of claim 5 wherein said first shaft (25) is substantially parallel with said feed beam (14).

* * * * *